US005460086A

United States Patent [19]

Bernardo et al.

[11] Patent Number: 5,460,086

[45] Date of Patent: Oct. 24, 1995

[54] ZIP CODE TO POSTNET CONVERSION PRINTING DEVICE

[76] Inventors: Joseph A. Bernardo, 29 Windsor Rd., Stamford, Conn. 06905-4234; Barry L. Natale, P.O. Box 1383, Stamford, Conn. 06904-1383

[21] Appl. No.: 29,621

[22] Filed: Mar. 11, 1993

[51] Int. Cl.[6] ..... B41J 1/22

[52] U.S. Cl. ..... 101/93.18; 101/93.21; 101/103; 101/110

[58] Field of Search ..... 101/92, 103, 93.18, 101/93.21, 99, 95, 106, 110, 111

[56] References Cited

U.S. PATENT DOCUMENTS

| | | | |
|---|---|---|---|
| 3,955,497 | 5/1976 | Sydor | 101/93.26 |
| 4,057,015 | 11/1977 | Kodis | 101/93.29 |
| 4,406,222 | 9/1983 | Holland-Letz et al. | 101/92 |
| 4,441,419 | 4/1984 | Sours | 101/110 |
| 4,485,735 | 12/1984 | Jonca | 101/93.18 |
| 4,762,063 | 8/1988 | Yeagle | 101/93.29 |
| 5,237,919 | 8/1993 | Kinstrey et al. | 101/103 |

*Primary Examiner*—Edgar S. Burr
*Assistant Examiner*—John S. Hilten
*Attorney, Agent, or Firm*—Evelyn M. Sommer

[57] ABSTRACT

A bar code conversion device for automatically converting the decimal digits of a selected postal ZIP Code into the corresponding POSTNET bar code has a first set of digit wheels with faces for the decimal digits, a second set of bar code wheels with faces for the bar code segments corresponding to the decimal digits, and a set of linkages coupling each pair of associated digit and bar code wheels so that they can be rotated to selected digit positions of a ZIP Code in tandem. In the mechanical embodiment, the device is a hand stamp for stamping the bar code segment faces on an article. An electromechanical version has input digit wheels and an output printer. An electronic version has an input keypad and an output printer. The bar code is applied on an article for mailing, and is optically readable by the United States Postal Service's bar code readers.

9 Claims, 5 Drawing Sheets

ZIP CODE TO POSTNET CONVERSION PRINTING DEVICE

FIELD OF THE INVENTION

This invention generally relates to a bar code conversion device, particularly a device for converting the decimal digits of a postal ZIP Code into the appropriate POSTNET bar code for automated mail-processing.

BACKGROUND ART

The United States Postal Service (U.S.P.S.) increasingly uses automated, computer-controlled machinery to sort mail more efficiently. Two vital machines are the optical character reader (OCR) and the wide-area bar code reader (WABCR). These machines can recognize reliably and speedily the numeric information, specifically postal bar codes, on pieces of mail. The bar codes are converted into numeric destination data for high-speed sorting, benefiting both the U.S.P.S. and the postal customers.

The bar code can be applied to the envelope by the customer or by the U.S.P.S. The U.S.P.S. uses the OCR for this purpose. The OCR scans the address and converts it into a bar code, which it prints on the envelope. If the customer applies the bar code, mail-processing is accelerated because the OCR can be bypassed. The envelope goes directly to the WABCR for sorting.

FIG. 1 shows schematically the respective paths for coded and uncoded pieces of mail. Uncoded envelope 10 passes through OCR 20, which scans its address 30. OCR 20 then prints bar code 40 on envelope 10, which proceeds through WABCR 50 to await delivery, as indicated at block 60. Coded envelope 11, already printed with bar code 40, bypasses OCR 20 and proceeds directly to WABCR 50.

The U.S.P.S. encourages its business customers to apply their own bar codes. This saves money for the U.S.P.S. and the customers, and speeds mail delivery. See, for example, Publication 67 of the United States U.S.P.S., "Automation Plan for Business Mailers," October 1989. The use of OCR to read and interpret printed addresses on mail can result in errors due to illegible print or unrecognizable fonts, and OCR cannot currently be used with a high degree of reliability for handwritten addresses. If an envelope, label, flat or package cannot be read using OCR, then it generally has to be diverted to manual sorting or a non-automated piece of equipment which is more labor intensive.

The U.S.P.S.'s OCR and WABCR equipment are programmed to recognize POSTNET bar codes. The POSTNET bar code is a unique bar code system used by the U.S.P.S. It symbolizes a destination ZIP Code through a combination of tall and short bars. The complex symbology of the POSTNET bar code will be explained further herein.

There is existing electronic equipment which can access a database of addresses to print the addresses with POSTNET bar codes on envelopes. This sophisticated equipment is, however, beyond the means of many small businesses. The present invention provides a convenient, effective, and inexpensive way of applying the bar code before mailing. It can also effectively be used by non-business customers.

SUMMARY OF THE INVENTION

The present invention provides a device for converting a postal ZIP Code to the corresponding POSTNET postal bar code and applying the bar code to an envelope, label, flat or package for mailing. The POSTNET bar code is readable by the U.S.P.S.'s OCR and WABCR machinery. The device of the invention may operate by various means, such as mechanical (rubber-stamp, for example), electromechanical, or electronic (completely automated) devices.

The POSTNET bar code is a complex numerically-based system. Manually translating ZIP Codes to POSTNET bar codes would be difficult and time-consuming. The present invention accomplishes this function automatically. It also allows for different types of accepted ZIP Code patterns, as explained below.

The preferred embodiment of the device of the invention has two linked sets of individually rotatable concentric wheels. One set of wheels contains the numerical digits, which are used to select the digits of a given ZIP Code (the input). The other set of wheels contains the corresponding segments of POSTNET bar code (the output). Each wheel has twelve faces which are marked with the corresponding bar code segments, a frame bar, and/or a blank. Selecting the ZIP Code digits on the first set of wheels results in automatic positioning of the corresponding POSTNET bar code segments on the other set for stamping on the envelope, label, flat or package. The piece of mail then can be processed without the need for OCR scanning by the U.S.P.S. The U.S.P.S. may use the more accurate bar code readers instead of the costlier, more labor intensive, and less reliable OCR's to process mail having customer-applied bar codes.

Other objects, features, and advantages of the invention will be apparent from the within detailed description and drawings.

DETAILED DESCRIPTION OF THE INVENTION

Figure 1:
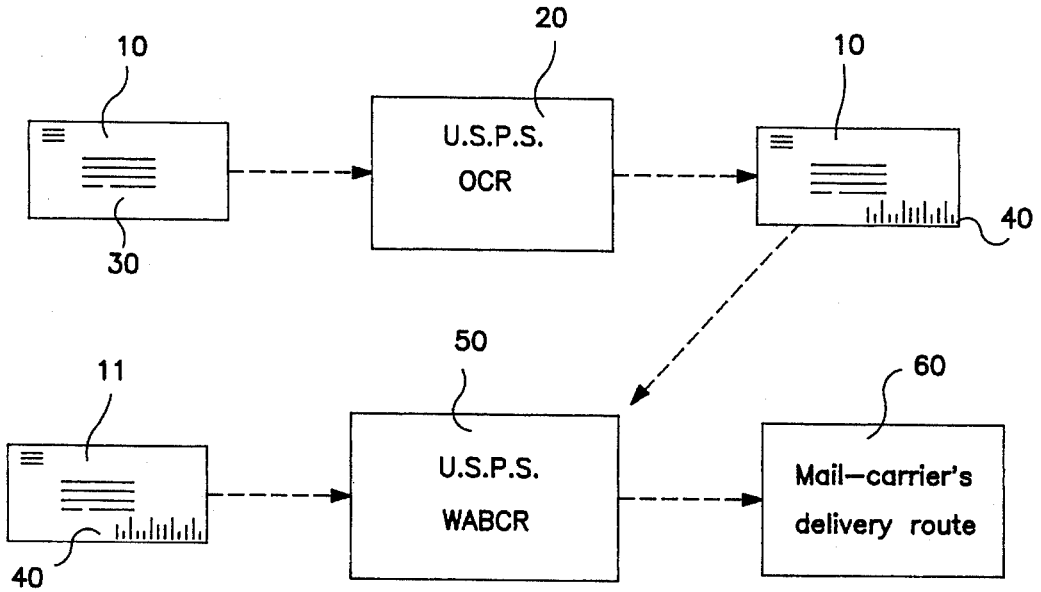
FIG. 1 (PRIOR ART)
FIG. 1 shows schematically the paths of bar-coded and non-bar-coded pieces of mail through the U.S.P.S. mail sorting system.
Figure 2:
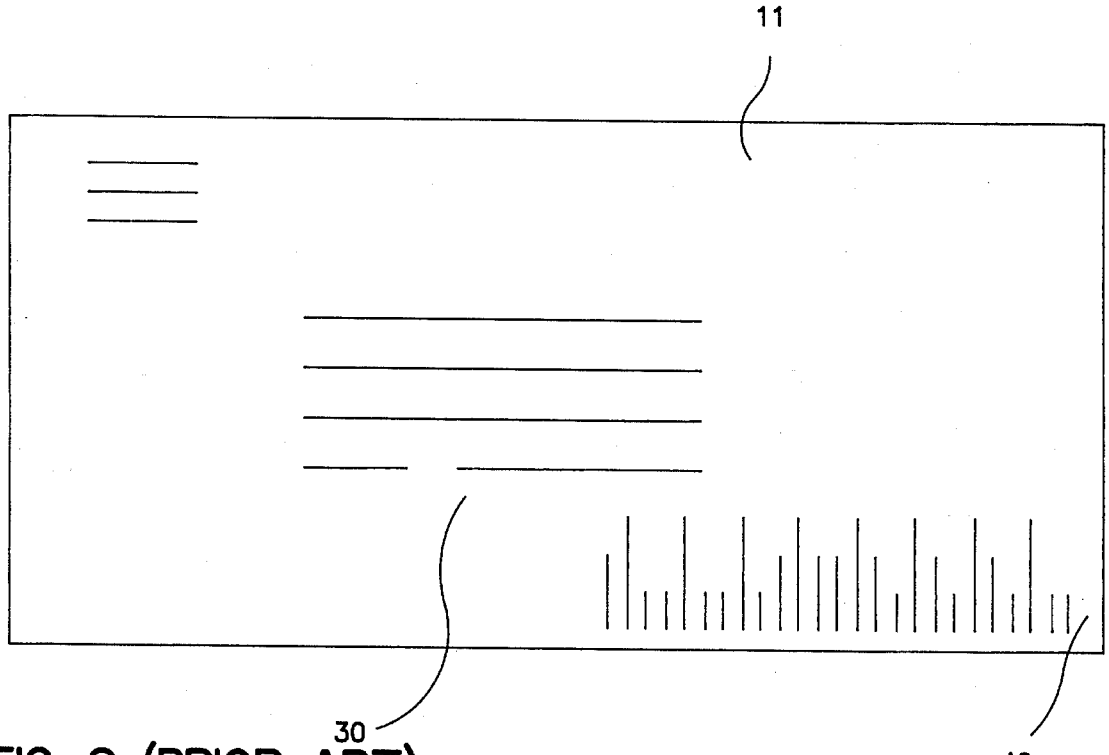
FIG. 2 (PRIOR ART)
FIG. 2 shows a typical envelope marked with a POSTNET bar code corresponding to the ZIP Code of an address.
Figure 3:
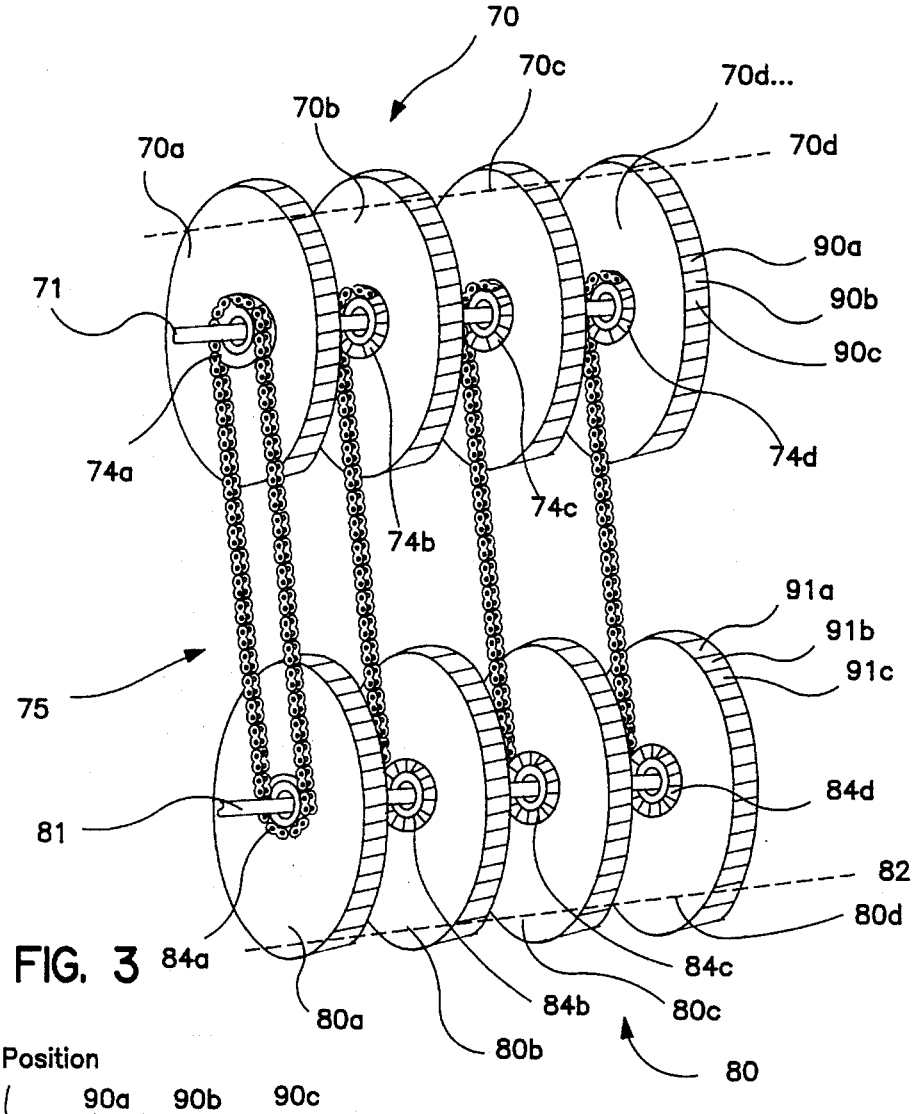
FIG. 3 is a view of a mechanical embodiment of the device, showing the two linked sets of digit and bar code wheels.
Figure 4:
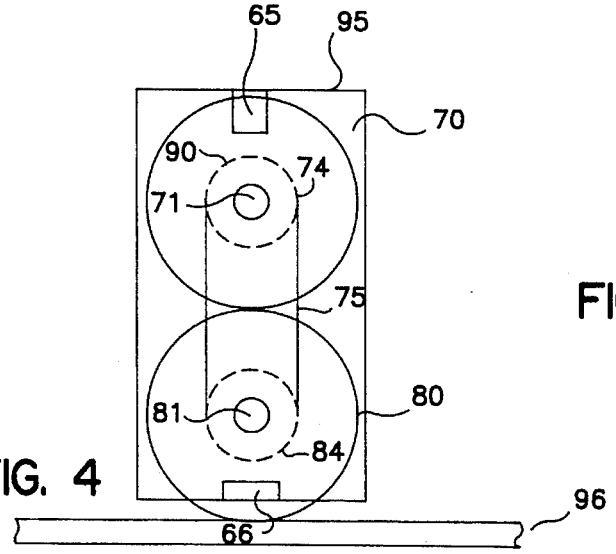
FIG. 4 is a schematic side view of the device of FIG. 3.
Figure 5:
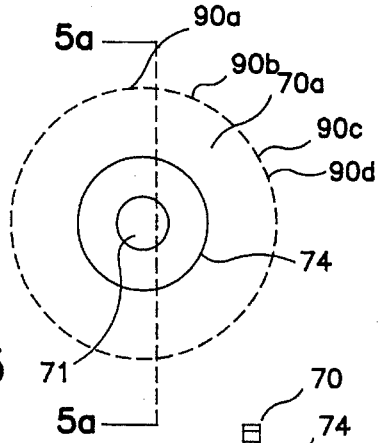
FIG. 5 is a side view and FIG. **5*a*** a front view of a wheel.
Figure 5A:
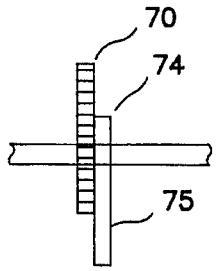

FIGS. 3–5 illustrate a preferred embodiment of the invention in the form of a mechanical stamp device. The stamp device has a first set 70 of individually rotatable wheels **70*a*, 70*b*, 70*c*, . . . for the numerical digits of a ZIP Code, and a second set 80 of individually rotatable wheels 80*a*, 80*b*, 80*c*, . . . for the corresponding POSTNET bar code segments. Each set of wheels is mounted on respective axles 71 and 81**.

The digit wheels each have respective gears or sprockets 74a, 74b, 74c, . . . fixedly attached on one side. Similarly, the bar code wheels each have respective gears or sprockets 84a, 84b, 84c, . . . fixedly attached on the same side. The gear or sprocket of each digit wheel is linked to the gear or sprocket of its corresponding bar code wheel by a linkage 75, such that when the digit wheel is rotated for selection of a numerical digit of the ZIP code at a selection or display position 72, the associated bar code wheel is rotated in tandem to position the corresponding bar code segment at an output position 82. The linkages 75 may consist of chains, gearing, rubber-toothed drivebands, etc. The linkages or wheels preferably include detent elements to insure that the wheels can temporarily lock into the selected positions.

Each of the digit wheels has the same number of faces 90a, 90b, 90c, . . . marked with the decimal digits and other fill elements for the ZIP code. Similarly, each of the bar code wheels has the same number of faces 91a, 91b, 91c, . . . marked with the corresponding bar code segments and other fill elements for the POSTNET bar code. The preferred embodiment has twelve faces per wheel for the ten decimal digits and two fill elements.

As shown in FIG. 4, the two sets of wheels 70 and 80 are rotatably mounted in a housing or frame 95 for the stamp device. Each wheel of the digit set can be individually dialed to the face containing the desired digit for display in the display window 65. When the user selects the appropriate string of digits to represent a given ZIP Code, the corresponding string of POSTNET bar code segments is automatically positioned on the second set of wheels through the gearing or other linkage 75 at the output window 66 for stamping on the envelope, label, flat or package 96.

FIG. 5 shows a side view of a digit wheel 70a having the preferred number of twelve individual faces 90a, 90b, 90c, . . . Ten of the faces of each wheel have a decimal digit. The eleventh face of each wheel either is a blank or a space or framing bar element. The twelfth face is a blank. If a five-digit Zip code is used, blank spaces are needed for subsequent digit positions. If a nine-digit Zip code is used, the framing bar is needed at the outer position. The use of these faces will be explained in more detail below. The faces of the bar code set of wheels include the corresponding ten bar code segments, a frame bar, and/or a blank.

The U.S.P.S. uses three standardized ZIP Code formats: five-digit, nine-digit, and eleven-digit. The current invention accommodates each. The POSTNET bar code convention can incorporate all three ZIP Code formats. The POSTNET bar code convention consists of a pattern of side-by-side tall and short bars. Each decimal digit (0–9) is represented by five bars, two tall and three short, which together make up a bar code segment. The tall bars represent binary ones; the short bars represent binary zeros. Each bar has a particular weight or value depending on its place in the segment. Going from left to right, the place-values are seven, four, two, one, and zero.

Thus, a tall bar has a value of seven in the left-most place, a value of two in the middle place, a value of zero in the right-most place, and so on. A short bar has a value of zero in any place. The following is an example (where i=short bar, and I= tall bar):

| | | |
|---|---|---|
| Place-value | 7 4 2 1 0 | 7 4 2 1 0 |
| Bars | I i i I i=8 | i I i I i=5 |

-continued

| | | |
|---|---|---|
| Numerical value | 7+0+0+1+0=8 | 0+4+0+1+0=5 |

The bar code designation for zero is a special case. The POSTNET symbology requires two tall bars in each code segment. Yet only one place (the right-most place) has a value of zero. Thus, representing the digit zero with two tall bars is impossible, since a tall bar in any other place would have a value greater than zero.

An exception therefore is made, and zero is represented by the following configuration: I I i i i , which normally would represent eleven (7+4). Because it is not a single digit, the number eleven would not be represented by a decimal bar code segment. By definition, then, the bar code segment that has a numerical value of eleven designates zero.

All POSTNET bar codes begin and end with a framing bar. These mark the boundaries of the bar code for the WABCR. Framing bars are always tall bars. They have no corresponding element in the ZIP Code.

All bar codes also have a correction digit immediately to the left of the right-hand framing bar. The correction digit allows the WABCR to solve for a missing or obscured digit in a bar code. The correction digit is computed by adding the digits of the ZIP Code and subtracting the sum from the next higher multiple of ten. Using the ZIP Code 13511 as an example, 1+3+5+1+1=11. The next higher multiple of ten is twenty, so 20–11=9, and "9" is therefore the correction digit. Using the ZIP Code 06905 as another example, 0+6+9+0+5=20. The sum twenty subtracts from the multiple of two times ten, so 20–20=0, and "0" is the correction digit for this ZIP Code.

The same procedure is also used for nine- (ZIP+4) and eleven-digit ZIP Codes. For example, for the ZIP+4 code 60654-9971, then 6+0+6+5+4+9+9+7+1=47. The next higher multiple of forty-seven is fifty, so 50–47=3, and "3" is the correction digit.

The WABCR can therefore solve for a missing or illegible digit by summing the digits represented by the legible bar code segments and the correction digit. If the sum is other than a multiple of ten, then the missing digit can be computed by subtraction. In the future, the U.S.P.S. may eliminate the use of the correction digit. In that case, the device would need wheels for only eleven positions, or the correction digit position may be replaced by a blank.

Figure 8:
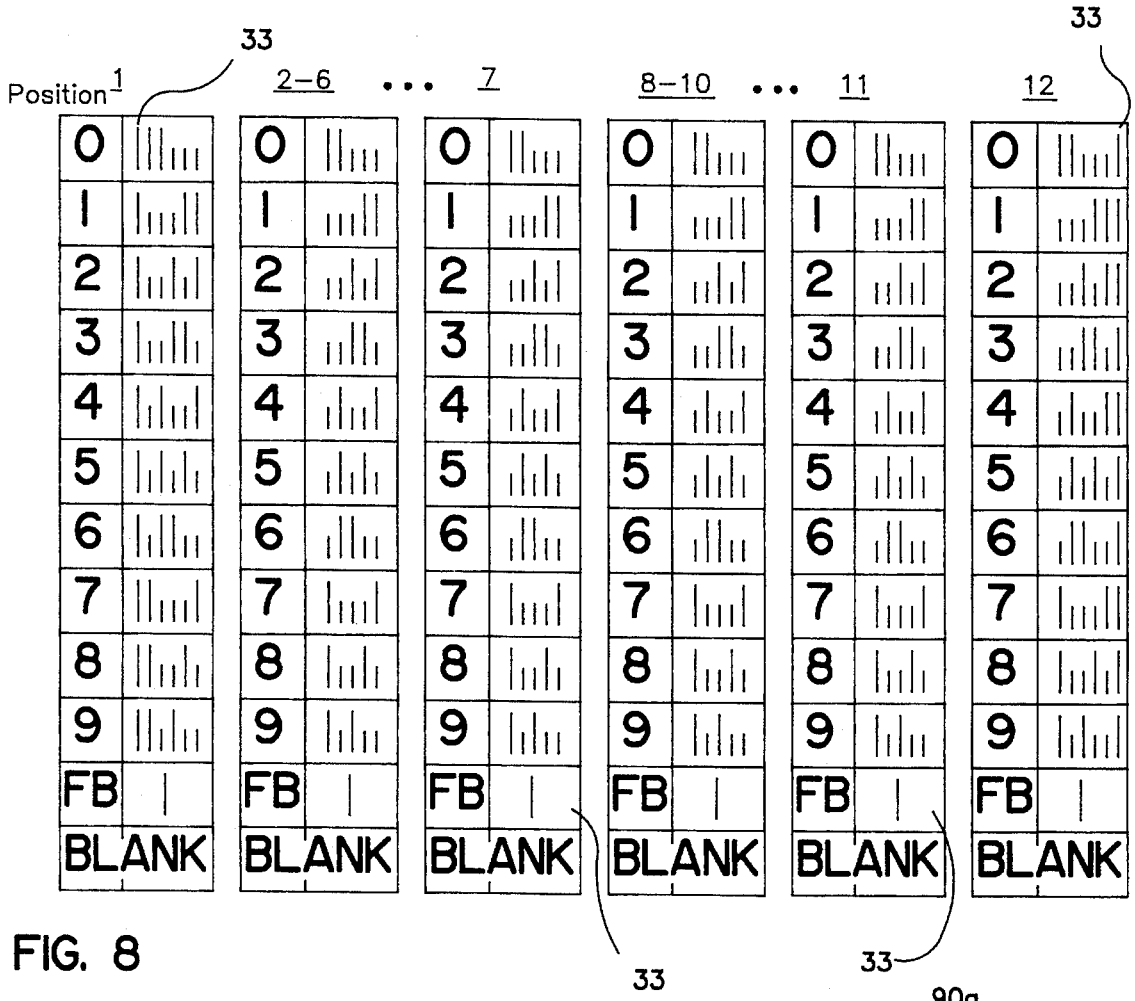
FIG. 8 is a table showing the correspondence of the elements of the wheels for the numerical digits with the elements of the wheels for POSTNET bar codes.

In FIG. 8, the conversion equivalents are shown for the twelve wheels of the digit and bar code sets. For each wheel, the digit faces are shown in the left-hand column, and the corresponding bar code faces are shown in the adjoining right-hand column. The wheel #1 occupies "position one" in the ZIP Code. The bar code segments for wheels #1 and #12 includes frame bars 33 as the outermost bars in its bar code sequence. The five wheels #2–6 are used with wheel #1 for a five-digit ZIP Code and the correction digit. The wheel #7 can provide the ending frame bar (F.B.) 33 for a five-digit ZIP Code. Alternatively, it is used with wheels #1–6 and #8–10 to form the nine digits of the ZIP+4 Code and the correction digit. The wheel #11 provides the ending frame bar for the ZIP+4 Code. Alternatively, wheel #1–11 are used for an eleven-digit ZIP Code and wheel #12 is used for the correction digit.

The U.S.P.S. is planning for use of an eleven-digit bar code called the Advanced Bar Code (ABC). In this future system, the correction digit may be eliminated. The twelveth position would not be needed, and a fill element would be adjusted accordingly. In the ABC system, the last two numerals of the street address are appended to the nine-digit (ZIP+Four) ZIP Code. This increases the total number of bars from fifty-two to sixty-two. Mail with customer-applied ABC's goes directly to the Delivery Bar Code Sorter (DBCS), bypassing the OCR. The DBCS sorts the mail into carrier-delivery sequence according to the two extra digits. This sorting function is otherwise manually done by the mail-carrier. Automating it greatly reduces the mail-carrier's workload at the post office.

Figure 9:
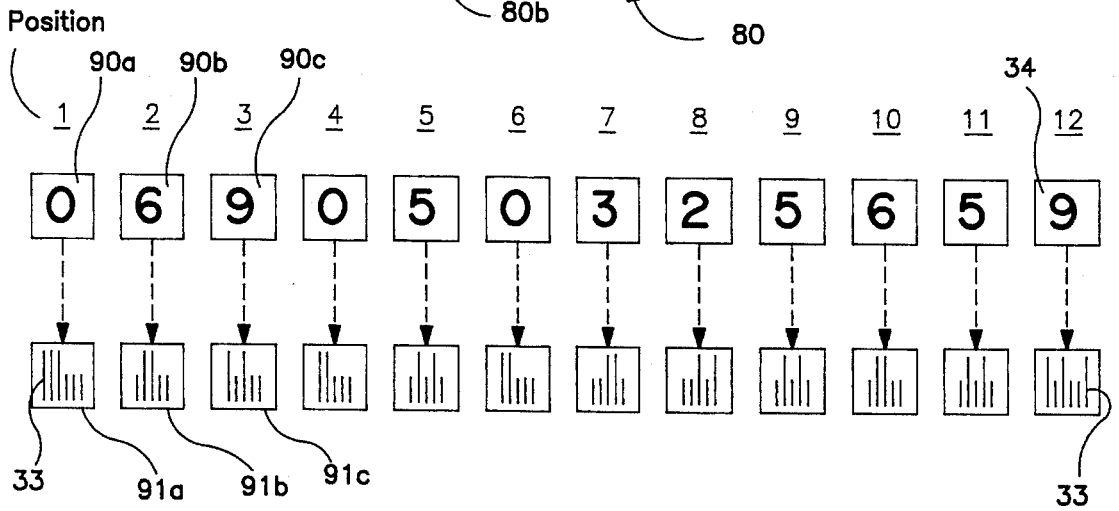
FIG. 9 shows the conversion of a particular ZIP Code into its corresponding POSTNET bar code.

FIG. 9 shows an example of an eleven-digit ZIP Code and its corresponding POSTNET bar code. Each input face 90*a*, 90*b*, 90*c*, etc. contains one digit of the ZIP Code. Position twelve contains the correction digit 34. Each output face 91*a*, 91*b*, 91*c*, etc. contains the corresponding POSTNET bar code segment, with left and right framing bars 33.

Figure 6:
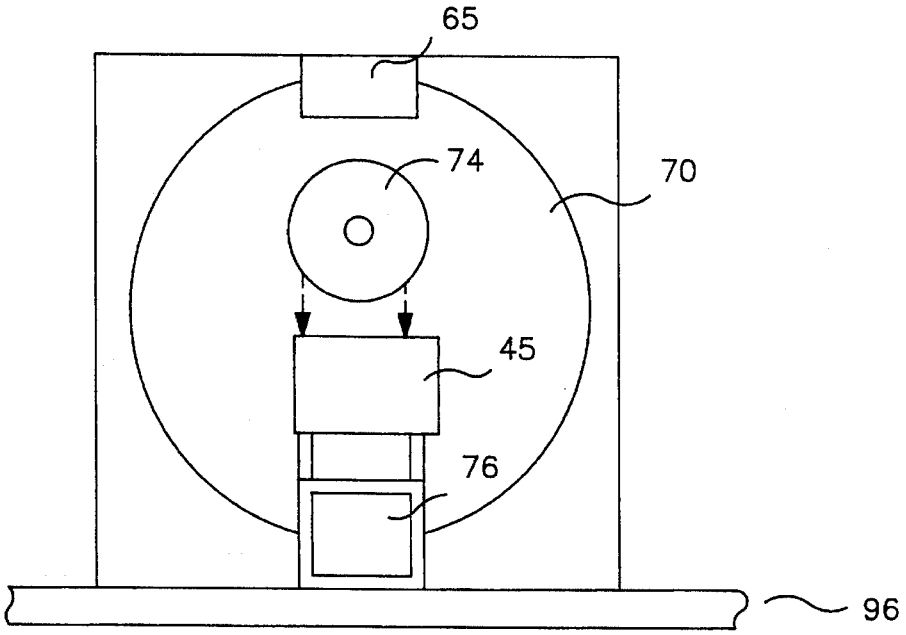
FIG. 6 is a schematic illustration of an electro-mechanical embodiment.

The invention may be embodied using other means, such as electro-mechanical or electronic components. FIG. 6 illustrates an electro-mechanical embodiment in which the input ZIP Code is selected by dialing the digit wheels 70 to the selection positions at window 65. A sensor and conversion circuit 45 detects the selected positions of the digits and converts the digits to the corresponding POSTNET bar code segments, such as by a ROM look-up table. The output of the conversion circuit is sent to a printhead 46, such as a dot matrix, ink jet, thermal, laser, impact, or other type of printer, which prints the POSTNET bar code on the envelope 96.

Figure 7:
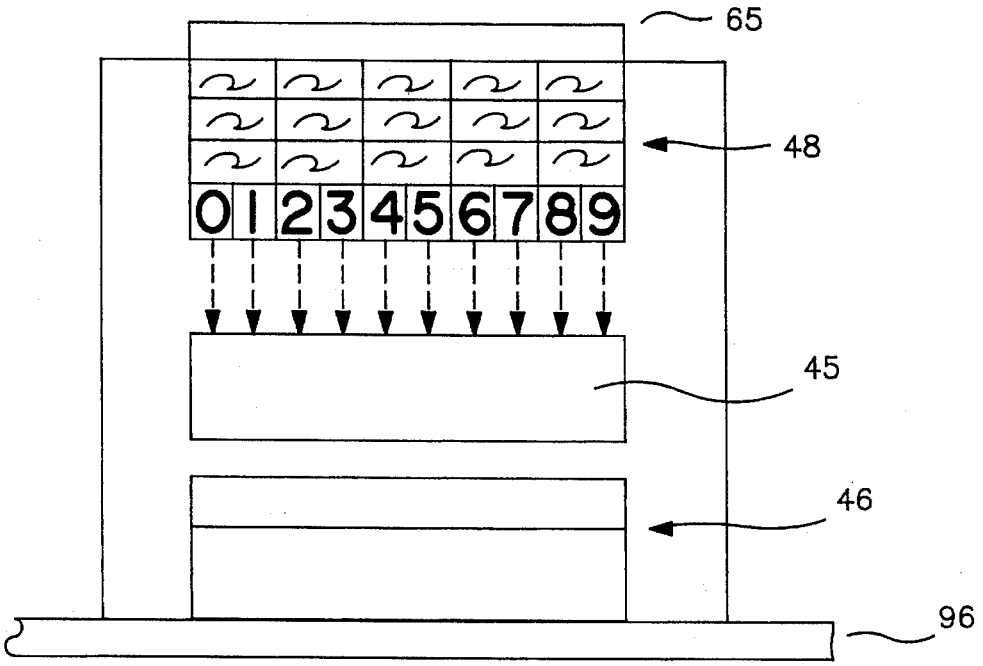
FIG. 7 is a schematic illustration of an electronic embodiment.

FIG. 7 illustrates a completely electronic embodiment in which the input ZIP Code is selected with a keypad 48, such as used in electronic calculators. The input ZIP Code is displayed on an LED or LCD display 65. A conversion circuit 45 translates the input ZIP Code into its equivalent bar code and drives the print-head 46 to generate the appropriate POSTNET bar code on the envelope 96.

Figure 10:
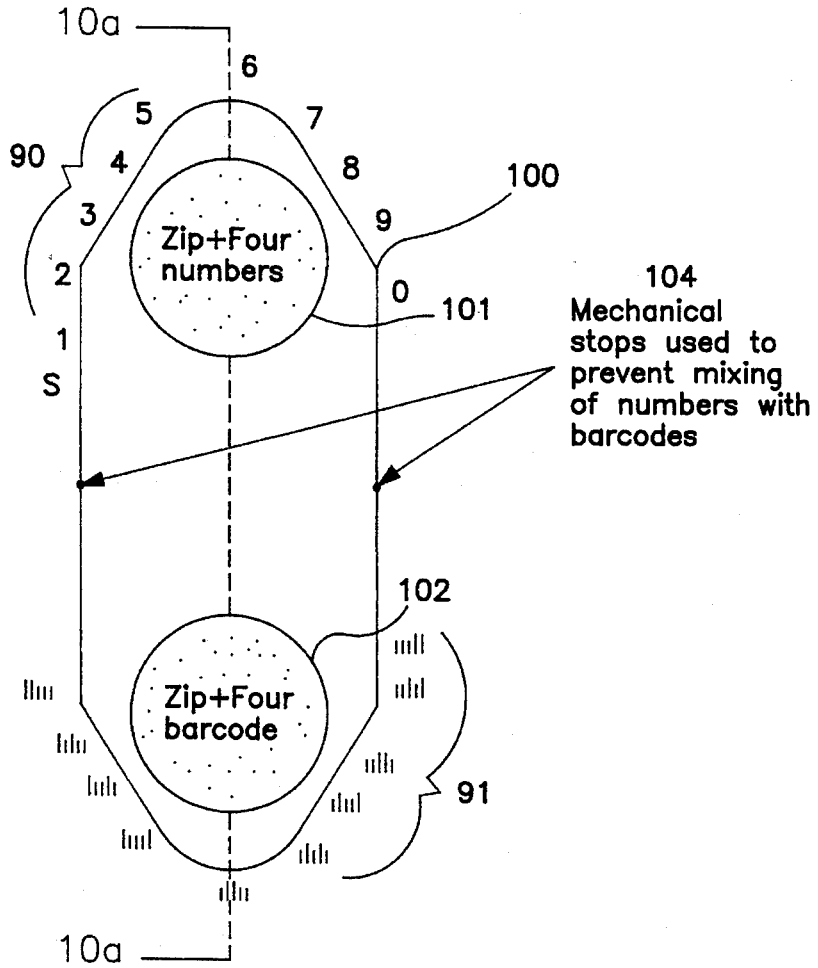
FIG. 10 is a side view of another mechanical embodiment using rubber belts, and FIG. **10*a*** is a front view of a wheel position.
Figure 10A:
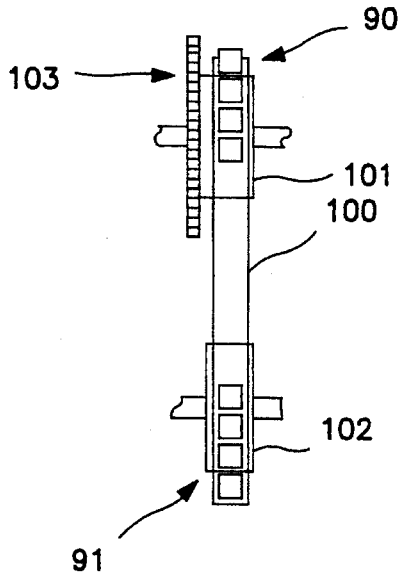

FIG. 10 is a schematic illustration of another mechanical embodiment of the invention. This embodiment is similar in concept to the embodiment of FIG. 3 except that the digits and bar code elements are embossed on the outer surfaces of respective belts 100 bands entrained over an associated sets of wheels 101, 102. Mechanical stops 104 on the belts prevent the movement of number or barcode elements beyond their permitted range of positions. The belts may be made, for example, of high-strength rubber and are entrained over the rims of the respective wheels. As shown in front view in FIG. 10*a*, the upper wheel is rigidly connected to a dial wheel 103 for selection of the desired digit element 90 and the corresponding bar code segment 91. Instead of a lower wheel 102, a simple smooth bar may be used. A window is provided at the top portion for numeric checking. The bar code segments selected at the lower portion are output as a manual stamp on the article to be mailed.

Numerous modifications and variations are of course possible in light of the principles of the invention disclosed above. All such modifications and variations are intended to be included within the spirit and scope of the invention, as defined in the following claims.

We claim:

1. In a device for manually marking a POSTNET bar code corresponding to a desired postal ZIP code on an article, the improvement comprising:

a housing having an upper portion provided with a first window at an uppermost edge thereof for display of a selected series of decimal digits on respective faces of a set of digit wheels therethrough, and a lower portion provided with a second window at a lowermost edge thereof for positioning a corresponding series of bar code segments on respective faces of a set of bar code wheels therethrough;

a first set of digit wheels rotatably mounted concentrically in parallel with each other on a first axle extending horizontally in a widthwise direction in said upper portion of said hosusing, each digit wheel being individually rotatable and having a plurality of faces spaced over a circumference thereof marked with decimal digits, said first set having a number of wheels for at least a corresponding number of digit positions of a desired postal ZIP code, a second set of bar code wheels rotatably mounted concentrically in parallel with each other on a second axle extending horizontally in said lower portion of said housing in parallel with said first axle and associated in paired relation with respective ones of said digit wheels, each bar code wheel being individually rotatable and having a plurality of faces spaced over a circumference thereof provided with bar code segments corresponding to the decimal digits of the associated digit wheel, a set of linkages each of which couples a respective digit wheel for rotation in tandem with its associated bar code wheel, such that rotation of a given digit wheel to select a decimal digit face at a display position of the digit wheel proximate said first window at said upper portion of said housing results in like rotation of the associated bar code wheel to position the corresponding bar code segment face at a printing position of the bar code wheel proximate said second window at said lower portion of said housing, wherein each pair of associated digit and bar code wheels have respective sprockets attached on the same sides thereof coupled by a respective one of said linkages, and means for marking the selected bar code segments positioned by rotation of the associated digit wheels at said second window on an article, and further wherein each of said digit wheels and corresponding bar code wheels has twelve faces including ten decimal digits, an extra face, and a blank.

2. In a device for manually marking a POSTNET bar code corresponding to a desired postal ZIP code on an article, the improvement comprising:

a housing having an upper portion provided with a first window at an uppermost edge thereof for display of a selected series of decimal digits on respective faces of a set of digit wheels therethrough, and a lower portion provided with a second window at a lowermost edge thereof for positioning a corresponding series of bar code segments on respective faces of a set of bar code wheels therethrough;

a first set of digit wheels rotatably mounted concentrically in parallel with each other on a first axle extending horizontally in a widthwise direction in said upper portion of said housing, each digit wheel being individually rotatable and having a plurality of faces spaced over a circumference thereof marked with decimal digits, said first set having a number of wheels for at least a corresponding number of digit positions of a desired postal ZIP code, a second set of bar code wheels rotatably mounted concentrically in parallel with each other on a second axle extending horizontally in said lower portion of said housing in parallel with said first axle and associated in paired relation with respective ones of said digit wheels, each bar code wheel being individually rotatable and having a plurality of faces spaced over a circumference thereof provided with bar code segments corresponding to the decimal digits of the associated digit wheel, a set of linkages each of which couples a respective digit wheel for rotation in tandem with its associated bar code wheel, such that rotation of a given digit wheel to select a decimal digit face at a display position of the digit wheel proximate said first window at said upper portion of said housing results in like rotation of the associated bar code wheel to position the corresponding bar code segment face at a printing position of the bar code wheel proximate said second window at said lower portion of said housing, wherein each pair of associated digit and bar code wheels have respective sprockets attached on the same sides thereof coupled by a respective one of said linkages, and means for marking the selected bar code segments positioned by rotation of the associated digit wheels at said second window on an article, and further wherein the faces of a first wheel in a first position of said bar code set have bar code segments provided thereon which includes first frame bars.

3. In a device for manually marking a POSTNET bar code corresponding to a desired postal ZIP code on an article, the improvement comprising:

a housing having an upper portion provided with a first window at an uppermost edge thereof for display of a selected series of decimal digits on respective faces of a set of digit wheels therethrough, and a lower portion provided with a second window at a lowermost edge thereof for positioning a corresponding series of bar code segments on respective faces of a set of bar code wheels therethrough;

a first set of digit wheels rotatably mounted concentrically in parallel with each other on a first axle extending horizontally in a widthwise direction in said upper portion of said housing, each digit wheel being individually rotatable and having a plurality of faces spaced over a circumference thereof marked with decimal digits, said first set having a number of wheels for at least a corresponding number of digit positions of a desired postal ZIP code, a second set of bar code wheels rotatably mounted concentrically in parallel with each other on a second axle extending horizontally in said lower portion of said housing in parallel with said first axle and associated in paired relation with respective ones of said digit wheels, each bar code wheel being individually rotatable and having a plurality of faces spaced over a circumference thereof provided with bar code segments corresponding to the decimal digits of the associated digit wheel, a set of linkages each of which couples a respective digit wheel for rotation in tandem with its associated bar code wheel, such that rotation of a given digit wheel to select a decimal digit face at a display position of the digit wheel proximate said first window at said upper portion of said housing results in like rotation of the associated bar code wheel to position the corresponding bar code segment face at a printing position of the bar code wheel proximate said second window at said lower portion of said housing, wherein each pair of associated digit and bar code wheels have respective sprockets attached on the same sides thereof coupled by a respective one of said linkages, and means for marking the selected bar code segments positioned by rotation of the associated digit wheels at said second window on an article, and further wherein each set includes twelve wheels for accomodating five-digit, nine-digit, and eleven-digit ZIP codes, and the twelfth wheel's bar code segments has last frame bars.

4. The device of claim 3, wherein the seventh and eleventh wheels of said bar code set include framing bars.

5. A device for manually marking different types of POSTNET bar codes corresponding to desired types of postal ZIP codes on an article, comprising:

first means provided with selecting means for selecting digit elements in twelve digit positions, the twelve digit positions encompassing any selected series of digit positions of lesser number corresponding to a desired type of ZIP code, second means provided with converting means for converting the digit elements selected by said first means into corresponding bar code elements of twelve bar code segments, the twelve bar code segments encompassing the conversion of any selected series of digit positions for a desired type of ZIP code into a corresponding bar code output, linkage means coupling said first means to said second means such that selection of digit elements for the digit positions of a desired postal ZIP code by said first means results in conversion to the corresponding bar code elements for the bar code segments by said second means, and marking means for marking the corresponding bar code elements converted by said second means as a bar code output on an article, wherein said twelve digit positions are defined as a series of correspondingly numbered digit positions, said twelve bar code segments are defined as a matched series of correspondingly numbered bar code segments, each of said twelve digit positions includes twelve digit elements selectable for that digit position including ten decimal digit elements, an extra element, and a blank element, each of said twelve bar code segments include twelve bar code elements matched to the twelve digit elements selectable for the respective digit position, and wherein:

(a) the first bar code segment matched to the first digit position includes a beginning frame bar provided with the bar code elements for the corresponding decimal digit elements;

(b) the seventh bar code segment includes an ending frame bar for a five-digit ZIP code as the extra element;

(c) the eleventh bar code segment includes an ending frame bar for a nine-digit ZIP code as the extra element;

(d) the twelveth bar code segment matched to the twelveth digit position includes an ending frame bar provided with the bar code elements for the corresponding decimal digit elements for use as the ending frame bar of an eleven-digit ZIP code, whereby said device is usable for marking the POSTNET bar codes corresponding to five-digit, nine-digit, and eleven-digit postal ZIP codes.

6. The device of claim 5, wherein said first means is a first set of digit wheels individually rotatable and having a plurality of faces marked with decimal digits, said second means is a second set of bar code wheels associated with respective ones of said digit wheels which are individually rotatable and have a plurality of faces provided with the corresponding bar code segments thereon, and said linkage means is a set of linkages each of which couples a respective digit wheel for rotation in tandem with its associated bar code wheel.

7. The device of claim 5, wherein said first means is a first set of digit wheels individually rotatable and having a plurality of faces marked with decimal digits, said second means is an electronic sensor and conversion circuit for sensing selected positions of said first set of digit wheels and electronically converting the selected decimal digits to the corresponding bar code segments, and said marking means is a printer coupled to an output of said sensor and conversion circuit for printing the bar code segments.

8. The device of claim 5, wherein said first means is a keypad having keys for the respective decimal digits, said second means is an electronic conversion circuit coupled to said keypad for converting the selected decimal digits to the corresponding bar code segments, and said marking means is a printer coupled to an output of said conversion circuit for printing the bar code segments.

9. The device of claim 5, wherein said first means, second means and linkage means are comprised of a plurality of belts each having a first set of decimal digit elements and a second set of corresponding bar code segments formed on an outer surface of the respective belt, and an associated pair of first and second belt supporting portions over which the respective belt is entrained, at least said first belt supporting portion being a wheel which is rotatable for moving a selected decimal digit element to an input position of the device and for likewise moving a corresponding bar code segment to an output position of the device for marking the corresponding bar code segments on an article.

* * * * *